US005190220A

United States Patent [19]

Bolton

[11] Patent Number: 5,190,220

[45] Date of Patent: Mar. 2, 1993

[54] AIR BRUSH APPARATUS HAVING AN IMPROVED NOZZLE AND CONNECTION MECHANISM

[76] Inventor: Terence W. Bolton, c/o Bolton Research Limited, Unit 6, City Business Centre, Basin Road, Chichester, West Sussex PO19 2DU, England

[21] Appl. No.: 717,427

[22] Filed: Jun. 19, 1991

[30] Foreign Application Priority Data

Jun. 20, 1990 [GB] United Kingdom ..... 9013745

[51] Int. Cl.[5] ..... B05B 7/24

[52] U.S. Cl. ..... 239/305; 239/326; 239/346; 239/418; 239/433; 222/209; 222/401

[58] Field of Search ..... 239/302, 326, 337, 346, 239/375, 398, 418, 433, 525, 152–154, DIG. 14, 303–306; 222/179, 209, 401

[56] References Cited

U.S. PATENT DOCUMENTS

| | | | |
|---|---|---|---|
| 1,125,875 | 1/1915 | Paasche | 239/DIG. 14 |
| 1,179,095 | 4/1916 | Hall | 239/DIG. 14 |
| 2,354,064 | 7/1944 | Rose | 239/326 |
| 2,579,909 | 12/1951 | Dieffenbach | 222/179 |
| 2,906,463 | 9/1959 | Curry | 239/326 |
| 4,079,893 | 3/1978 | Bass | 239/346 |

FOREIGN PATENT DOCUMENTS

| | | | |
|---|---|---|---|
| 2709217 | 9/1978 | Fed. Rep. of Germany | 239/346 |
| 2035138B | 9/1982 | United Kingdom | 239/346 |

*Primary Examiner*—Andres Kashnikow
*Assistant Examiner*—Karen B. Merritt
*Attorney, Agent, or Firm*—Kinney & Lange

[57] ABSTRACT

Apparatus for dispensing a fine spray of liquid particles comprises a manually operated pump connected to supply air under pressure directly to a nozzle so positioned that air leaving the nozzle is directed onto and over the nib of a pen releasably supported within a holder with the pen nib in close proximity with the nozzle outlet to cause liquid from the pen to be dispensed as a fine particulate spray in air.

11 Claims, 3 Drawing Sheets

AIR BRUSH APPARATUS HAVING AN IMPROVED NOZZLE AND CONNECTION MECHANISM

BACKGROUND OF THE INVENTION

This invention relates to apparatus for dispensing a fine spray of liquid particles and more especially, but not exclusively, to liquid dispensers known as air brushes.

An air brush for non-contact marking of objects is disclosed in GB 2035138 in which a jet of compressed air released from a cylinder or other source of air under pressure is directed onto a fibrous wick carrying marking material, e.g. a felt-tipped pen. The compressed air jet is controlled by means of a valve connected to the air cylinder. Such an air brush is both cumbersome and expensive because of the presence of the compressed-air cylinder and the need for a relatively complicated and expensive valve system for controlling the flow of compressed air.

SUMMARY OF THE INVENTION

The present invention sets out to provide a simplified air brush which removes the need for a source of compressed air and associated valve system but, by use of which, the quality of the artwork achieved is as good as that which can be achieved using conventional air brush equipment. Liquid dispensing apparatus in accordance with the invention can also be employed to dispense fine sprays of media other than colourants or inks.

According to the present invention in one aspect, there is provided apparatus for dispensing a fine spray of liquid particles, the apparatus comprising a manually operated pump connected to supply air under pressure directly to a nozzle so positioned that air leaving the nozzle is directed onto and over a nib of a pen-like container releasably supported within a holder with the nib in close proximity to the nozzle outlet to cause liquid from the pen to be dispensed as a fine particulate spray in air.

In another aspect, there is provided apparatus for dispensing a fine spray of liquid particles, the apparatus comprising a manually operated pump connected to supply air under pressure through a flexible hose directly to a nozzle, means for positioning a pen-like container with its nib in close proximity to the outlet of the nozzle whereby air under pressure from the pump is directed onto and over the nib to entrain particles therefrom and dispense such particles as a fine spray.

The nozzle preferably includes a locating surface against which a shoulder of the pen adjacent its nib abuts in use to ensure correct location of the nib with respect to the nozzle outlet.

The nozzle and the pen may, in use of the apparatus, be retained within discrete channels of a separable holder, the channels being mutually inclined so that compressed air leaving the nozzle flows directly onto and over the nib of the pen.

The channel for retaining the pen may be defined by a sleeve releasably secured to the holder. More than one such sleeve may be provided to enable pens having a variety of diameters and cross-sections to be retained by the holder.

The pump may be foot or hand operated and may comprise a bulb of a flexible material such as rubber which can be squeezed or otherwise deformed to expel air under pressure therefrom. Alternatively, the pump may take the form of a hand operated pump including a cylinder through which a sliding piston can be moved to expel air under pressure from the cylinder.

The flexible hose may be formed as a continuous spiral to assist connection to the pump and to the nozzle.

The liquid may be a colourant such as ink or an edible food colourant and the liquid source may comprise a conventional ink pen or a felt tipped marker. Alternatively, the liquid may comprise a scented medium, a disinfectant, a deodorant or an insecticide or pesticide contained in a pen-like container.

In a further aspect, there is provided apparatus for dispensing a fine spray of liquid particles, the apparatus comprising a manually operated pump including an outlet nozzle through which air under pressure is directed over the tip of a source of liquid releasably supported within retaining means carried by the pump housing.

The pump may comprise a piston slidably mounted within a cylindrical chamber, movement of the piston forcing air under pressure through the nozzle. The piston may be of hollow construction to house a liquid source, e.g. a pen or marker, when not in use.

The retaining means may comprise a suitably shaped bracket secured to or formed integral with the pump housing, the bracket being suitably inclined so that when a liquid source is retained therein, its tip lies adjacent to the pump nozzle.

BRIEF DESCRIPTION OF THE DRAWINGS

The invention will now be described by way of example only with reference to the accompanying diagrammatic drawings in which.

DETAILED DESCRIPTION OF THE PREFERRED EMBODIMENTS

Figure 1:
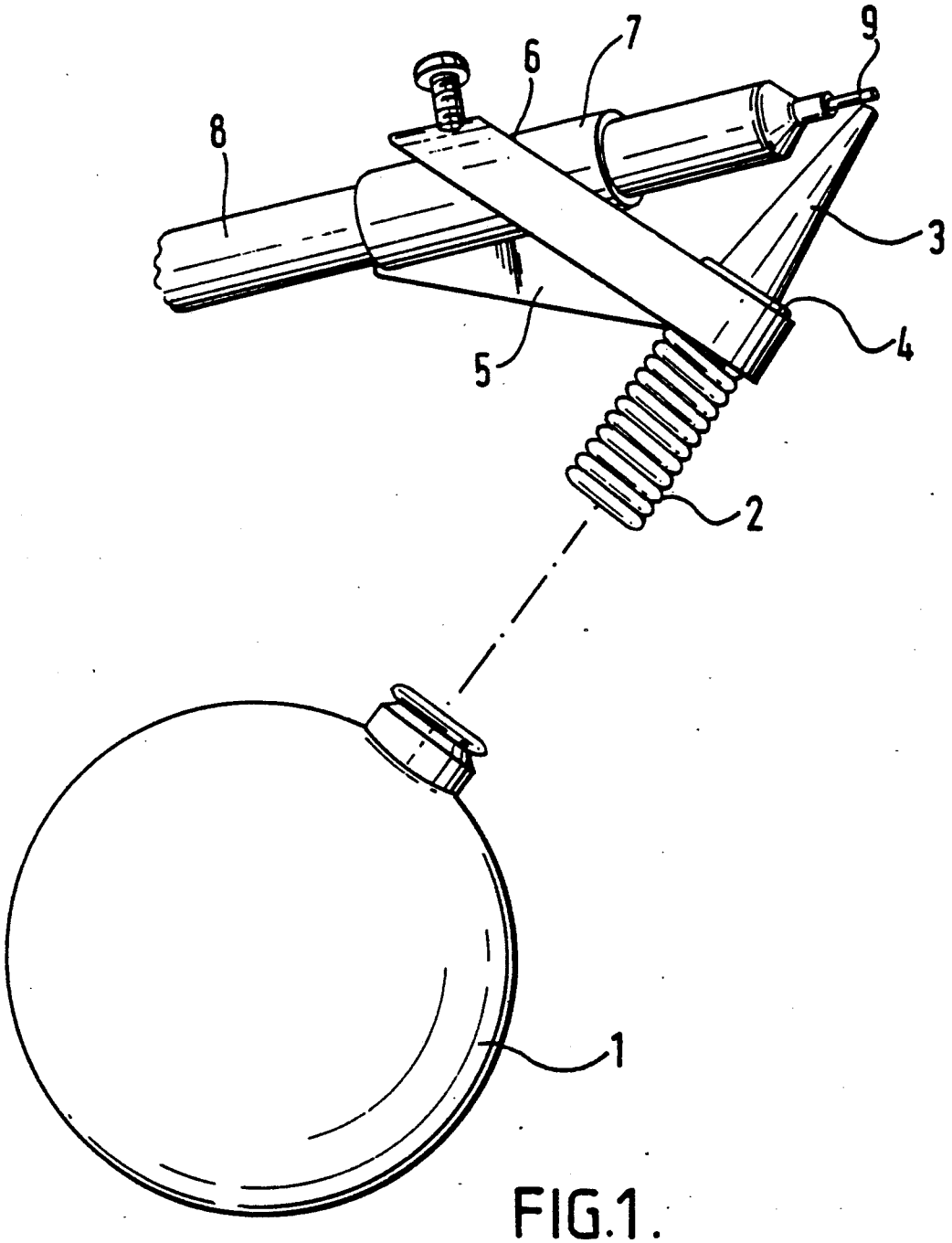
FIG. 1 is a perspective view of air brush apparatus in accordance with the invention.
Figure 2:
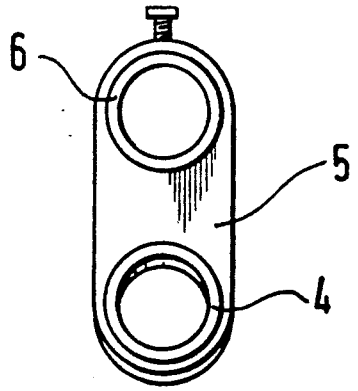
FIG. 2 is a front view of a part of the apparatus illustrated in FIG. 1.
Figure 3:
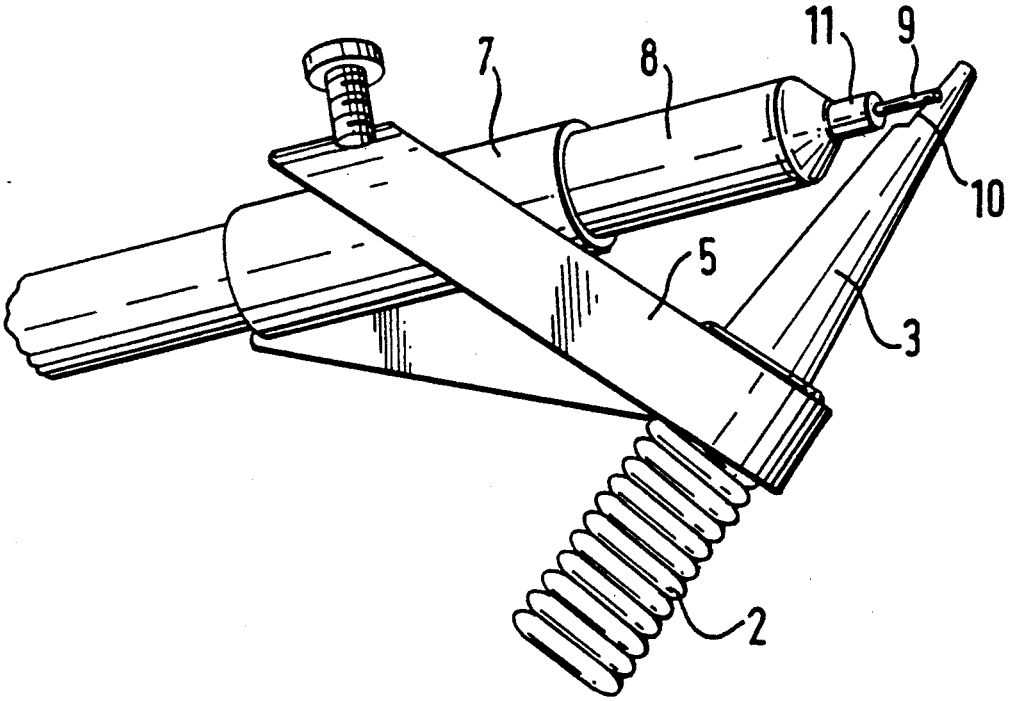
FIG. 3 is a side view to an enlarged scale of a nozzle used in the apparatus illustrated in FIG. 1.

The air brush illustrated in FIGS. 1 to 3 comprises a foot pump 1 connected by a flexible hose 2 to a nozzle 3 retained within a first channel 4 of a plastics holder 5. The holder 5 includes a second channel 6 within which is removably mounted a sleeve 7. The sleeve is retained in place by a suitable screw fixing. Positioned within the sleeve 7 is a pen 8.

As will be seen from FIGS. 1 to 3, the channels 4, 6 are mutually inclined so that the tip 9 of the pen is positioned in close proximity to the nozzle outlet. When using a nozzle as illustrated in FIG. 1, the tip 9 is positioned immediately downstream of the nozzle 3. In FIG. 3, however, the nozzle end includes a step 10 against which abuts the shoulder 11 of the pen for location purposes.

The holder 5 is designed to be held a specified distance away from the article on which a fine spray of particles is to be applied. Operation of the foot pump causes air under pressure to flow directly through the hose 2 and to exit from the nozzle 3. As this compressed air passes over the tip 9 of the pen, a fine dispersion of particles is produced.

Figure 3A:
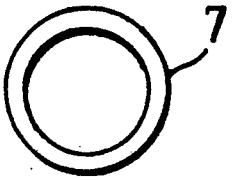
FIG. 3A is a front view of a sleeve of the present invention having a second diameter.
Figure 3B:
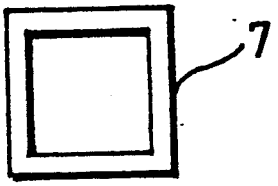
FIG. 3B is a front view of a sleeve of the present invention having a second cross-section.

The pen 8 may comprise a felt-tipped pen, a cartridge containing a technical drawing pen, the nib of a conventional pen or a pen-like cylindrical container including, for example, a dip tube through which a colourant such as ink can be withdrawn. Alternatively, edible food colourants, ink-based acrylic and emulsified paints may be dispensed by means of the apparatus. A selection of sleeves 7 may be provided to enable a variety of different liquid sources to be employed. For example, sleeve 7 can be formed with any number of cross-sections in any number of sizes. FIG. 3A shows sleeve 7 with a circular cross-section but with a diameter smaller than that shown in FIG. 3. Thus, sleeve 7 shown in FIG. 3A can accommodate liquid containers having a smaller diameter than pen 8. FIG. 3B shows sleeve 7 with a square cross-section. Thus, sleeve 7 shown in FIG. 3B can accommodate liquid containers having square exteriors, rather than simply the cylindrical exterior of pen 8.

In an alternative embodiment, the pen is replaced by a pen-like container (which may include a dip tube, a wick, a felt-tip or the like) of another liquid, e.g. a scented liquid, a deodorant, a disinfectant, an insecticide or a pesticide.

The shape and configuration of the nozzle 3 may take several forms, these including cylindrical, conical and undulating. The nozzle may include a discrete opening through which the tip of the liquid container may protrude.

Figure 4:
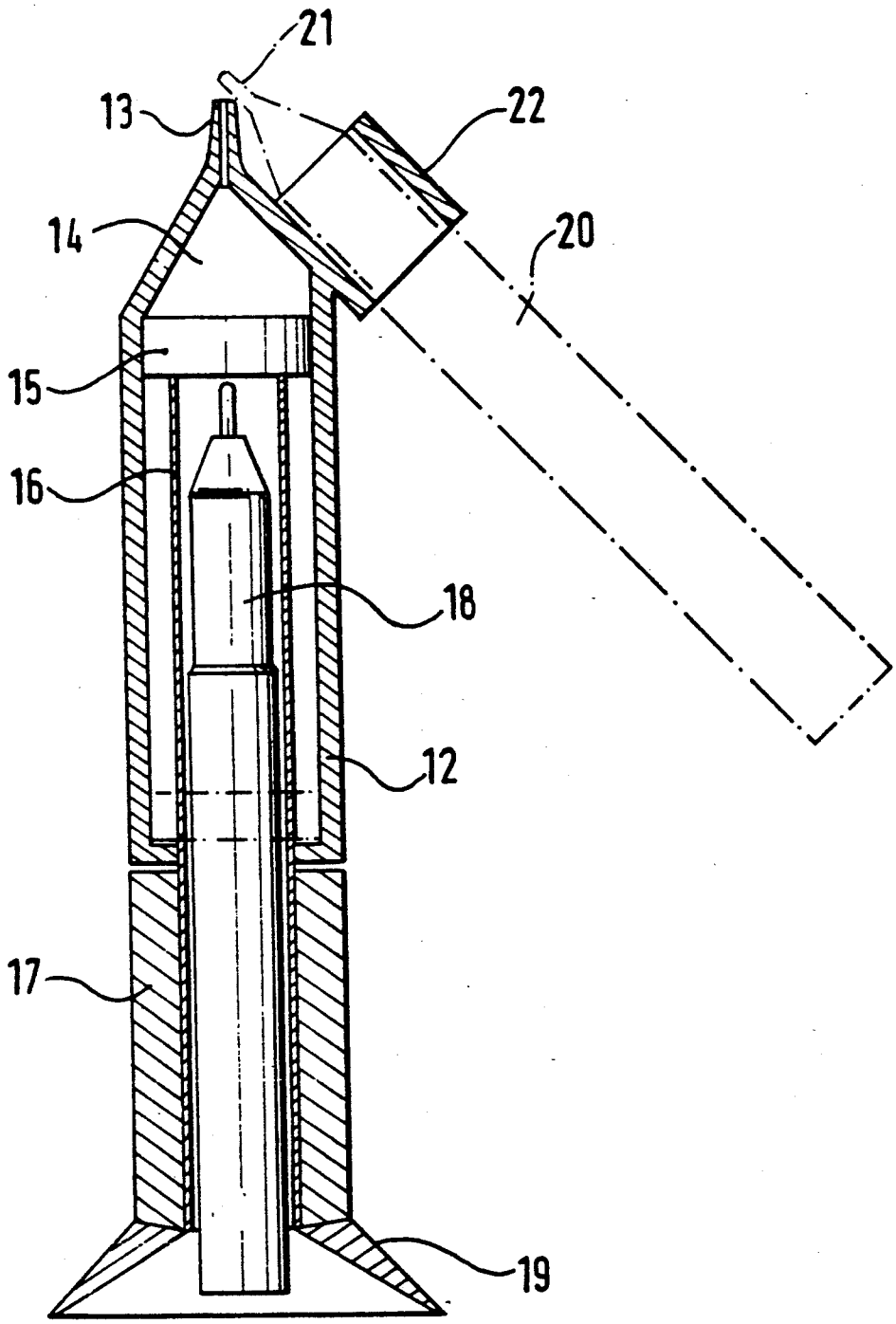
FIG. 4 is a side view partly in section of alternative apparatus in accordance with the invention.

The dispenser illustrated in FIG. 4 includes a hand-operated pump which comprises a cylindrical housing 12 which defines a nozzle 13, compression chamber 14 swept by a piston 15 carried by a plunger 16. The piston 15 typically comprises a washer of rubber or plastics. The plunger 16 includes a handle 17 by which the piston 15 can be moved through the chamber 14. The plunger is hollow to enable a liquid source such as a marker 18 to be stored when not in use. The end of the handle is flared to define a flange-stand 19.

Secured to one inclined face of the nozzle 13 is a bracket 22 for retaining a suitable liquid source.

In operation, a liquid source—for example a felt-tipped marker 20, is positioned within the bracket 22 with its tip 21 in the position shown in broken line. The plunger 16 is then moved by its handle 17 to cause the piston 15 to sweep the chamber 14 to cause air under pressure to emerge from the nozzle 13 and pass over the tip 21. As for the arrangement described above with reference to FIGS. 1 to 3, as the compressed air flows over the tip of the marker 20, liquid particles are entrained and are dispensed as a fine spray.

It will be appreciated that the foregoing is merely exemplary of one embodiment of dispensing apparatus in accordance with the invention and that modifications can readily be made thereto without departing from the true scope of the invention as defined by the appended claims.

I claim:

1. Apparatus for dispensing a fine spray of liquid particles, the apparatus comprising:

a nozzle having a nozzle outlet;

a manually operated pump connected to supply air under pressure directly to the nozzle; and a pen-like container having a nib and a shoulder adjacent the nib and being supported within a holder so that the nib is in close proximity to the nozzle outlet and so positioned that air leaving the nozzle outlet is directed onto and over the nib to cause liquid from the pen-like container to be dispensed as a fine particulate spray in air, the nozzle outlet being formed with a step to define an abutment surface against which cuts the shoulder of the pen-like container to correctly locate the nib with respect to the nozzle outlet.

2. Apparatus as claimed in claim 1 wherein the pump comprises a bulb of a flexible material which can be deformed to expel air under pressure therefrom.

3. Apparatus as claimed in claim 1 wherein the pump is a hand operated pump.

4. Apparatus as claimed in claim 1 wherein the holder has discrete channels and, in use of the apparatus, the nozzle and the pen-like container are retained within the discrete channels of the holder, the channels being mutually inclined so that compressed air leaving the nozzle outlet flows directly over and around the nib of the pen-like container.

5. Apparatus as claimed in claim 4 wherein the channel for retaining the pen-like container is defined by a sleeve detachably secured to the holder.

6. Apparatus as claimed in claim 5 wherein more than one sleeve is provided to enable a variety of pen-like containers of different diameter to be retained.

7. Apparatus as claimed in claim 5 wherein more than one sleeve is provided to enable a plurality of pen-like containers of different cross-section to be retained.

8. Apparatus as claimed in claim 1 wherein the pen-like container is a felt tipped marker.

9. Apparatus for dispensing a fine spray of liquid particles, the apparatus comprising:

a nozzle having an outlet;

a flexible hose connected to the nozzle;

a foot operated pump connected to supply air under pressure through the flexible hose directly to the nozzle, the nozzle outlet being formed with an abutment surface; and a pen-like container having a nib and having a surface adjacent the nib, the surface being located against the abutment surface of the nozzle outlet so the nib is in close proximity to the outlet of the nozzle whereby air under pressure from the pump is directed onto and over the nib to entrain particles therefrom and dispense such particles as a fine spray.

10. Apparatus for dispensing a fine spray of liquid particles, the apparatus comprising:

a nozzle having a nozzle outlet;

a holder connected to the nozzle and having a channel;

a manually operated pump connected to supply air under pressure directly to the nozzle; and a pen-like container having a nib and a shoulder adjacent the nib and being supported by a sleeve detachably mounted within the channel of the holder, the nozzle outlet being formed with a step to define an abutment surface against which abuts the shoulder of the pen-like container to correctly locate the nib with respect to the nozzle outlet so that air leaving the nozzle outlet is directed onto and over the nib of the pen-like container, the nib being in close proximity to the nozzle outlet to cause liquid from the pen-like container to be dispensed as a fine particulate spray in air, a plurality of sleeves being provided each of differing internal cross-section to enable a variety of pen-like containers of different cross-section to be retained within the holder.

11. Apparatus for dispensing a fine spray of liquid particles, the apparatus comprising:

a nozzle having a nozzle outlet;

a manually operated pump connected to supply air under pressure directly to the nozzle;

a pen-like container having a nib and being supported within a holder so that the nib is in close proximity to the nozzle outlet and so positioned that air leaving the nozzle is directed onto and over the nib to cause liquid from the pen-like container to be dispensed as a fine particulate spray in air; and wherein the pump comprises a piston slidably mounted within a cylindrical chamber, movement of the piston forcing air under pressure through the nozzle, and wherein the piston is hollow to house the pen-like container when the pen-like container is not in use.

* * * * *

UNITED STATES PATENT AND TRADEMARK OFFICE

CERTIFICATE OF CORRECTION

PATENT NO. : 5,190,220

DATED : March 2, 1993

INVENTOR(S) : TERENCE W. BOLTON

It is certified that error appears in the above-identified patent and that said Letters Patent is hereby corrected as shown below:

Col. 4, line 7, delete "cuts", insert --abuts--

Signed and Sealed this

Twenty-third Day of November, 1993

*Attest:*

Bruce Lehman

BRUCE LEHMAN

*Attesting Officer*

*Commissioner of Patents and Trademarks*